US009431761B2

(12) United States Patent
Fukaya et al.

(10) Patent No.: US 9,431,761 B2
(45) Date of Patent: Aug. 30, 2016

(54) CONNECTOR

(71) Applicant: YAZAKI CORPORATION, Tokyo (JP)

(72) Inventors: Tomoyoshi Fukaya, Shizuoka (JP); Moeko Fukada, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/819,498

(22) Filed: Aug. 6, 2015

(65) Prior Publication Data

US 2015/0349460 A1 Dec. 3, 2015

Related U.S. Application Data

(63) Continuation of application No. PCT/JP2014/052518, filed on Feb. 4, 2014.

(30) Foreign Application Priority Data

Feb. 12, 2013 (JP) ..... 2013-024728

(51) Int. Cl.
*H01R 13/40* (2006.01)
*H01R 13/627* (2006.01)
*H01R 13/422* (2006.01)
(Continued)

(52) U.S. Cl.
CPC ..... *H01R 13/6272* (2013.01); *H01R 13/4223* (2013.01); *H01R 13/113* (2013.01); *H01R 13/428* (2013.01)

(58) Field of Classification Search
CPC ..... H01R 13/4362; H01R 13/4361; H01R 13/4365; H01R 13/4223; H01R 13/113; H01R 13/187
USPC ..... 439/752, 752.2, 595, 852
See application file for complete search history.

(56) References Cited

U.S. PATENT DOCUMENTS 4,966,557 A 10/1990 Barkus et al.
5,281,175 A * 1/1994 Chupak ..... H01R 13/113 439/839

(Continued)

FOREIGN PATENT DOCUMENTS

JP 1-89474 U 6/1989
JP 10-289746 A 10/1998

(Continued)

OTHER PUBLICATIONS

International Search Report for PCT/JP2014/052518 dated Apr. 28, 2014 English Translation.

*Primary Examiner* — Hien Vu
(74) *Attorney, Agent, or Firm* — Sughrue Mion, PLLC

(57) ABSTRACT

An upper face plate constituting a box part of a female terminal is flared outward in a free state before the female terminal is inserted in the cavity, and is formed as a spring plate that is bent and deflected inward by being pressed inward from the outside while accumulating a spring force. A stabilizer is disposed on the free end of the upper face plate. A cavity of a connector housing includes a stabilizer guide that presses back the upper face plate to the regular position by sliding on the stabilizer while the female terminal is being inserted. Accordingly, rattling of the terminal is prevented after the terminal is inserted in the cavity of the connector housing while suppressing enlargement of the outside dimensions of the terminal.

4 Claims, 6 Drawing Sheets

(51) Int. Cl.
*H01R 13/11* (2006.01)
*H01R 13/428* (2006.01)

(56) References Cited

U.S. PATENT DOCUMENTS 6,089,928 A * 7/2000 Miwa ..... H01R 13/4223 439/595
6,872,093 B2 * 3/2005 Fukatsu ..... H01R 13/4362 439/595
6,905,376 B2 * 6/2005 Chen ..... H01R 13/4223 439/595
2011/0250805 A1 10/2011 Nishide

FOREIGN PATENT DOCUMENTS

JP 2005-44598 A 2/2005
JP 2010-33948 A 2/2010
JP 2011-222213 A 11/2011

* cited by examiner

CONNECTOR

CROSS-REFERENCE TO RELATED APPLICATION

This application is a continuation application of International Application PCT/JP2014/052518, filed on Feb. 4, 2014, and designating the U.S., the entire contents of which are incorporated herein by reference.

BACKGROUND OF THE INVENTION

1. Field of the Invention

The present invention relates to a connector that prevents rattling of a terminal accommodated in a cavity of a connector housing.

2. Description of the Related Art

In order to prevent rattling of a terminal inserted in a cavity of a connector housing, as illustrated in FIG. 6, a connector has been known in which spring parts 190 protrude outside a pair of side plates 121 of a box part 120 in a terminal 110 and the spring parts 190 are made to elastically abut against inner walls 182 of a cavity 181 facing each other constantly when the terminal 110 is inserted in the cavity 181 of a connector housing 180 (refer to Japanese Patent Application Laid-open No. 2005-44598).

However, if the spring parts 190 protrude outside the side plates 121 of the box part 120 as described above, an overall width of the terminal 110 becomes larger than the width between the side plates 121 of the box part 120, whereby the width of the cavity 181 accommodating the terminal 110 becomes wider. As a result, there is a problem of difficulty in miniaturization of the connector because of need of a wider pitch between the terminals.

SUMMARY OF THE INVENTION

The present invention has been made in view of the above-described circumstances. An object of the present invention is to provide a connector capable of preventing rattling of a terminal after the terminal is inserted in a cavity of a connector housing, while suppressing enlargement of the outside dimensions of the terminal.

In order to solve the above mentioned problem and achieve the object, a connector according to one aspect of the present invention includes a terminal configured to include a box part having a rectangular cylindrical shape formed by four face plates, and an electric wire connecting part in a rear direction of the box part; and a connector housing provided with a cavity accommodating the terminal and configured to lock the terminal with a lance provided in the cavity at the time the terminal is inserted in the cavity from the rear direction, wherein one face plate of the four face plates constituting the box part of the terminal is formed as a spring plate that is flared outward in a free state before the terminal is inserted in the cavity to be held in a regular position at which the rectangular cylindrical shape is formed, by deflecting inward and displacing by being pressed inward from the outside while accumulating a spring force, a free end of the face plate formed as the spring plate includes a stabilizer having a protrusion shape that is protruded outward, and the cavity of the connector housing includes an inclined guide portion and a holding guide portion, the inclined guide portion gradually pressing back the face plate formed as the spring plate to the regular position by sliding contact with the stabilizer while the terminal is being inserted in the cavity from the rear direction, the holding guide portion holding, at the regular position, the face plate pressed back to the regular position when the terminal is inserted to the final insertion position.

With the configuration of the connector described above, a face plate formed as a spring plate can be pressed back to a regular position by using a stabilizer that is protruded outward on a box part in a terminal while accumulating a spring force while the terminal is being inserted in a cavity. Accordingly, the connector can prevent rattling of the terminal housed in the cavity of a connector housing by the spring force that makes the box part of the terminal exert a pressing force on an inside wall of the cavity, and thereby improve contact reliability between the terminal and a counterpart terminal. Specifically, because the connector includes in the cavity: an inclined guide portion that presses back the face plate formed as the spring plate to the regular position; and a holding guide portion that holds the face plate pressed back to the regular position at the same position, the spring force of the face plate formed as the spring plate can be used by a slide of the stabilizer to prevent the rattling in stable conditions. In this case, because the face plate acting as the spring plate forms a rectangular cylindrical shape of the box part by being finally held at the regular position, the outside dimensions of the terminal does not expand, which means no need to enlarge the inside dimensions of the cavity. Accordingly, the connector can contribute to miniaturization of the connector without the need of enlarging the pitch between the terminals.

Further, in the connector according to another aspect of the present invention, the box part has the rectangular cylindrical shape formed by the four face plates including a first side face plate, a lower face plate, a second side face plate, and an upper face plate, the first side face plate through the upper face plate are formed by bending a single metal plate inward on a first bending line as a boundary between the first side face plate and the lower face plate, a second bending line as a boundary between the lower face plate and the second side face plate, and a third bending line as a boundary between the second side face plate and the upper face plate, a bending angle of the upper face plate with respect to the second side face plate is larger than a right angle so that the upper face plate is flared outward as a cantilevered-shape spring plate having a fulcrum on the third bending line, and the stabilizer having a protrusion shape protruding outward is formed by folding on a side edge in the free end side away from the third bending line on the upper face plate.

With the configuration of the connector described above, when bending a first side face plate through an upper face plate in order, the upper face plate is not bent to the end (to the position where the upper face plate contacts or comes most close to the first side face plate), but held at an angle halfway (held at an angle larger than a right angle). The upper face plate is thus made to serve as a cantilevered spring plate having a fulcrum on a third bending line that is a boundary between a second side face plate and the upper face plate. Thus, using the spring property of the upper face plate can prevent the rattling of the terminal inside the cavity of the connector housing by adopting such simple configuration.

Further, in the connector according to still another aspect of the present invention, a chamfered inclined portion is formed on a corner of a front end of the stabilizer in the terminal insertion direction to the cavity, and a flat portion is formed on a rear side of the inclined portion, the flat portion extending from an apex of the inclined portion in parallel to the terminal insertion direction.

With the configuration of the connector described above, an inclined portion formed on the front end corner portion of the stabilizer allows the stabilizer to smoothly move during running on the inclined guide portion in the connector housing side. In addition, a flat portion mounted on the rear side of the inclined portion allows the stabilizer to be held in stable conditions when the flat portion finally gets on a holding guide portion in the connector housing side.

Further, in the connector according to still another aspect of the present invention, the stabilizer is arranged to be in the same plane as the first side face plate in a free state before the terminal is inserted in the cavity, by setting a bending angle of the stabilizer with respect to the upper face plate flared outward at an angle larger than a right angle, and the inclined guide portion and the holding guide portion are provided on an inside wall with which the first side face plate of the cavity comes in contact.

With the configuration of the connector described above, because the stabilizer that lies in the same plane as the first side face plate falls down outward and pressingly contacts the inside wall with which the first side face plate of the cavity comes in contact when the upper face plate formed as the spring plate is pressed back to the regular position while the terminal is being inserted in the cavity, the spring force of the stabilizer can also contribute to preventing the rattling of the terminal.

The present invention is briefly explained as described above. Further, a detail of the present invention will be more clarified by reading through a mode for carrying out the invention described below (hereinafter referred to as "embodiment") by referring to the accompanying drawings.

BRIEF DESCRIPTION OF THE DRAWINGS

FIG. 1A is an appearance perspective view illustrating a whole configuration, FIG. 1B is a vertical cross-sectional view, and FIG. 1C is an essential part cross-sectional view of a box part;

FIG. 2A is an appearance perspective view illustrating a whole configuration, FIG. 2B is a vertical cross-sectional view of the center of a cavity, and FIG. 2C is a perspective cross-sectional view of the center of the cavity;

FIG. 3A is a vertical cross-sectional view, and FIG. 3B is a cross-sectional view of FIG. 3A along the line IIIb-IIIb;

FIG. 4A is a vertical cross-sectional view, and FIG. 4B is a cross-sectional view of FIG. 4A along the line IVb-IVb;

FIG. 5A is a vertical cross-sectional view, and FIG. 5B is a cross-sectional view of FIG. 5A along the line Vb-Vb.

DETAILED DESCRIPTION OF THE PREFERRED EMBODIMENTS

An embodiment of the present invention will be described hereinafter with reference to the accompanying drawings.

Figure 1A:
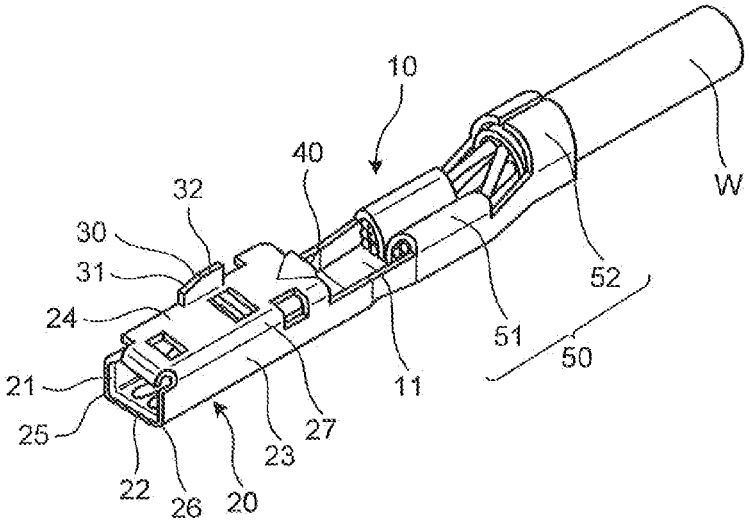
FIGS. 1A, 1B, and 1C are configuration diagrams illustrating a female terminal used for an embodiment of the present invention.
Figure 1B:
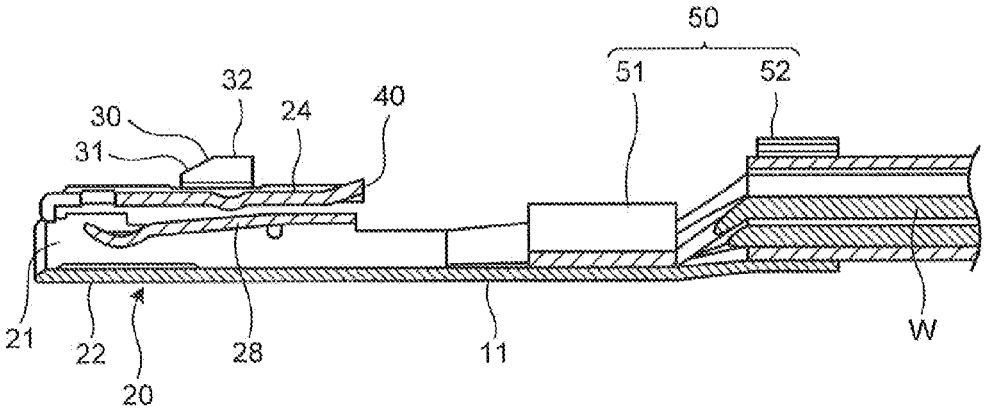
Figure 1C:
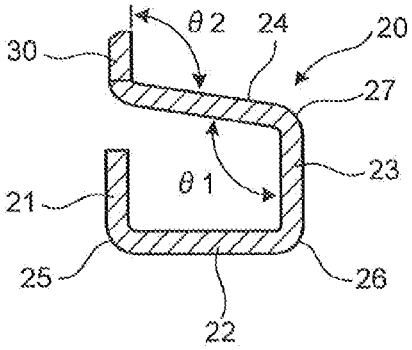
Figure 2A:
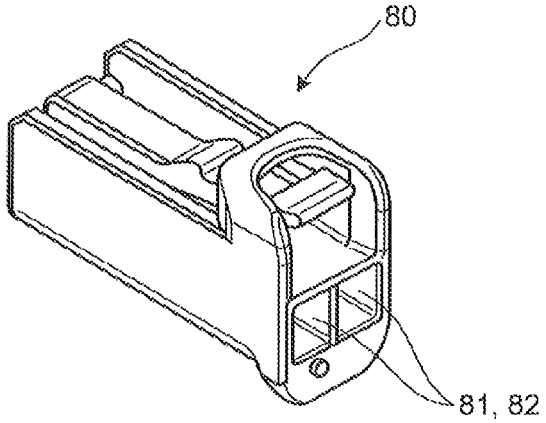
FIGS. 2A, 2B, and 2C are configuration diagrams illustrating a connector housing including the female terminal.
Figure 2B:
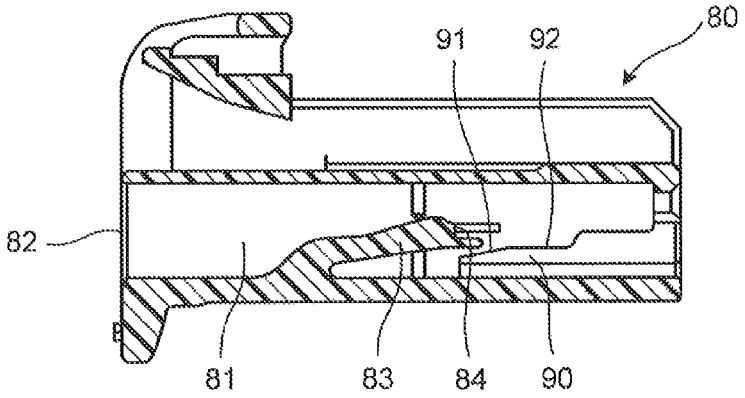
Figure 2C:
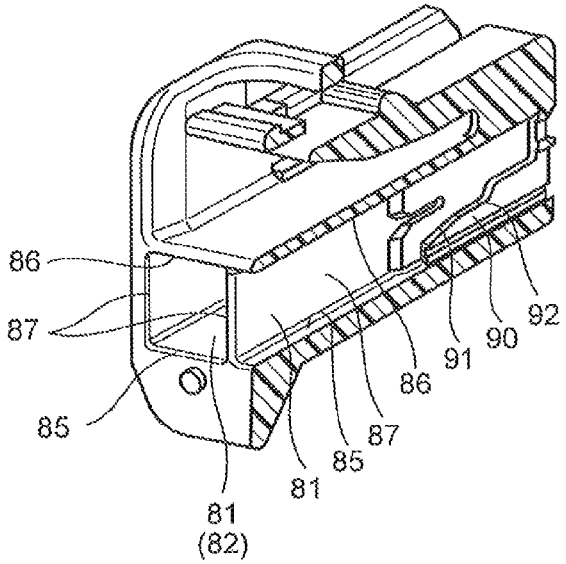

FIG. 1A through FIG. 1C are configuration diagrams of a female terminal used for an embodiment of the present invention, and FIG. 2A through FIG. 2C are configuration diagrams of a connector housing including the female terminal.

A connector of the embodiment includes: a required number of female terminals 10 illustrated in FIG. 1A through FIG. 1C; and a connector housing 80 illustrated in FIG. 2A to FIG. 2C. As illustrated in FIG. 1A through FIG. 1C, the female terminal 10, which is a terminal of the present invention, includes a box part 20 having a rectangular cylindrical shape formed by four face plates (which will be described later as a first side face plate 21, a lower face plate 22, a second side face plate 23 and an upper face plate 24) in the front portion. A tab mounted on a counterpart male terminal is inserted to the inside of the box part 20 and held by a contact piece 28 and the lower face plate 22. The female terminal 10 also includes an electric wire connecting part 50 in the rear direction of the box part 20. The electric wire connecting part 50 includes: a conductor crimping part 51 in the front side that crimps a conductor of an electric wire W; and a cover crimping part 52 in the rear side that crimps a covered portion of the electric wire W. The whole terminal is so formed by pressing one metal plate that the box part 20 and the electric wire connecting part 50 are linked together with a common bottom plate 11. A lance locking portion 40 locked by a locking portion 84 (described later) of a lance 83 in the connector housing 80 is formed in the rear end of the box part 20.

In the following explanation about the connector, typically, the side in which the counterpart male terminal is connected is referred to as "front" and the side in which the electric wire W is connected is referred to as "rear". Namely, "front" and "rear" with respect to the connector apply respectively to the following examples: "Front side" means the side in which the counterpart male terminal is connected, while "rear side" means the side in which the electric wire W is connected; "Front direction" means the direction in which the counterpart male terminal is connected, while "rear direction" means the direction in which the electric wire W is connected; "Front portion" means the portion in which the counterpart male terminal is connected, while "rear portion" means the portion in which the electric wire W is connected; and "Front end" means the end in which the counterpart male terminal is connected, while "rear end" means the end in which the electric wire W is connected.

As illustrated in FIG. 2A through FIG. 2C, the connector housing 80 formed by resin molding includes a plurality of the cavities 81 housing the female terminal 10. The connector housing 80 is so designed that the female terminal 10 is locked by the locking portion 84 of the lance 83 mounted inside the cavity 81 after the female terminal 10 is inserted in each of the cavity 81 from the rear direction, or an insertion slot 82 in the rear end.

One face plate (described later as an upper face plate 24) of the four face plates constituting the box part 20 of the female terminal 10: is flared outward in a free state before the female terminal 10 is inserted in the cavity 81; is deflected inward and displaced by being pressed inward from the outside while accumulating a spring force; and then is formed as the spring plate into a rectangular cylindrical shape held at a regular position.

Namely, the box part 20 having the rectangular cylindrical shape is formed by the first side face plate 21, the lower face plate 22, a second side face plate 23 and the upper face plate 24 as the four face plates. One metal plate of the first side face plate 21 through the upper face plate 24 is formed by being bent inward on: a first bending line 25 as a boundary between the first side face plate 21 and the lower face plate 22; a second bending line 26 as a boundary between the lower face plate 22 and the second side face plate 23; and a third bending line 27 as a boundary between the second side face plate 23 and the upper face plate 24. In addition, the upper face plate 24 is formed so as to be flared outward as a cantilevered-shape spring plate having a fulcrum on the third bending line 27 by being held at a bending angle θ1 of the upper face plate 24 with respect to the second side face plate 23 that is an angle larger than a right angle. A stabilizer 30 having a protrusion shape is formed by folding so as to be protruded outward on the side edge in the free end side of the upper face plate 24 formed as the spring plate. The free end of the upper face plate 24 means: a free end of the spring plate formed in a cantilevered shape as described above; in other words, a top end of the upper face plate 24 formed in a cantilevered shape having a fulcrum on the third bending line 27; and typically an end of the side facing the third bending line 27 in the upper face plate 24.

The stabilizer 30 is formed to include: an inclined portion 31 that is chamfered at a corner of the front end of the terminal insertion direction into the cavity 81; and a flat portion 32 that continues to the rear side of the inclined portion 31 and extends from the apex of the inclined portion 31 in parallel to the terminal insertion direction. The stabilizer 30 is arranged to be in the same plane as the first side face plate 21 in the free state before the female terminal 10 is inserted in the cavity 81 by setting a bending angle θ2 of the stabilizer 30 with respect to the upper face plate 24 flared outwardly at an angle larger than a right angle. The terminal insertion direction typically means an insertion direction in which the female terminal 10 is inserted toward the cavity 81.

A stabilizer guide 90, on which the inclined portion 31 and the flat portion 32 of the stabilizer 30 are slid when the female terminal 10 is inserted in the cavity 81 from the rear side, is included inside the cavity 81 of the connector housing 80. The cavity 81 is a rectangular space surrounded by a bottom wall 85, a ceiling wall 86 and both side walls 87, the stabilizer guide 90 is protruded inside (inside wall) of the one side wall 87 contiguous to the first side face plate 21 of the cavity 81. A lance 83 is disposed on the bottom wall 85 side so as to be bent upward and downward.

The stabilizer guide 90 includes: a inclined guide portion 91 that gradually presses back the upper face plate 24 formed as the spring plate to the regular position by sliding contact with the stabilizer 30 while the female terminal 10 is being inserted in the cavity 81 from the rear direction; and a holding guide portion 92 that holds the upper face plate 24 pressed back to the regular position at the same position when the female terminal 10 is inserted to the final insertion position. Here, the final insertion position means: typically, the final position at which the insertion of the female terminal 10 against the cavity 81 completes; for example, the position at which the female terminal 10 is pressed into the cavity 81 to the front direction side to the extent possible.

Functions during assembly will be explained below.

Figure 3B:
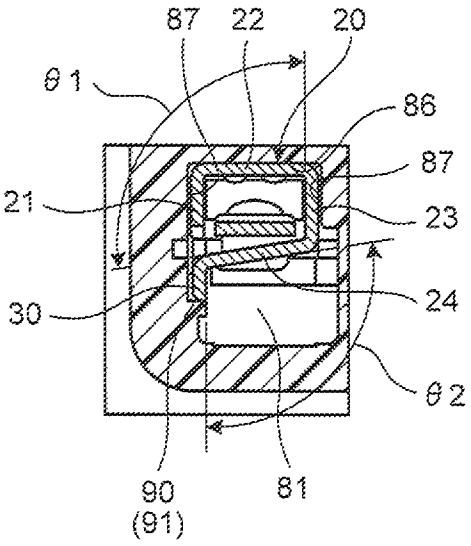
FIGS. 3A and 3B are illustrative views illustrating that the female terminal is inserted halfway into the cavity of the connector housing.
Figure 3A:
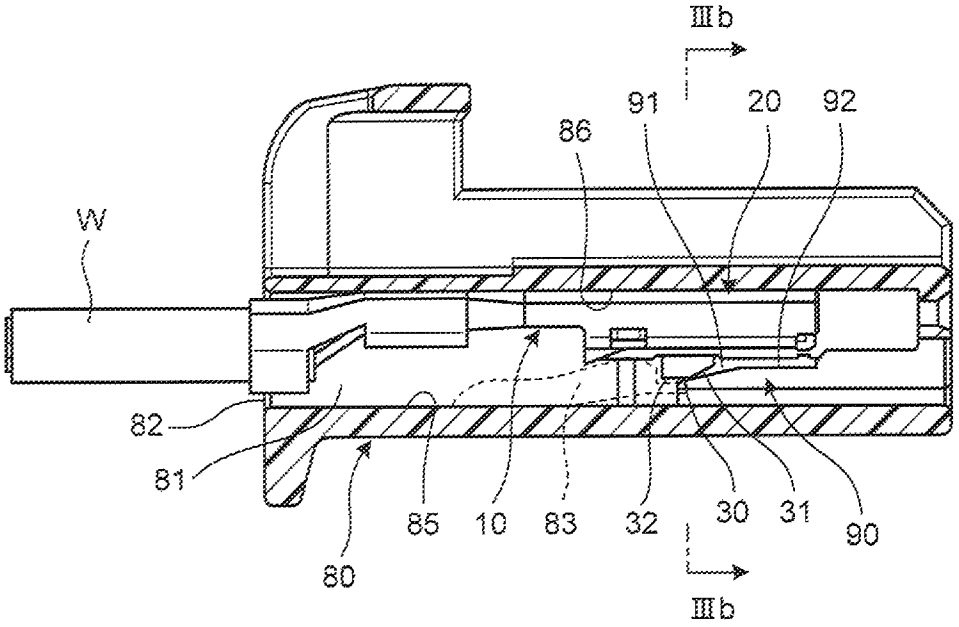
Figure 4B:
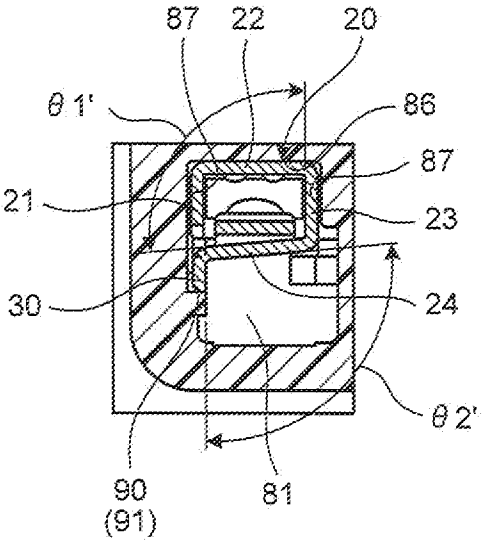
FIGS. 4A and 4B are illustrative views illustrating that the female terminal is inserted further into the cavity of the connector housing.
Figure 4A:
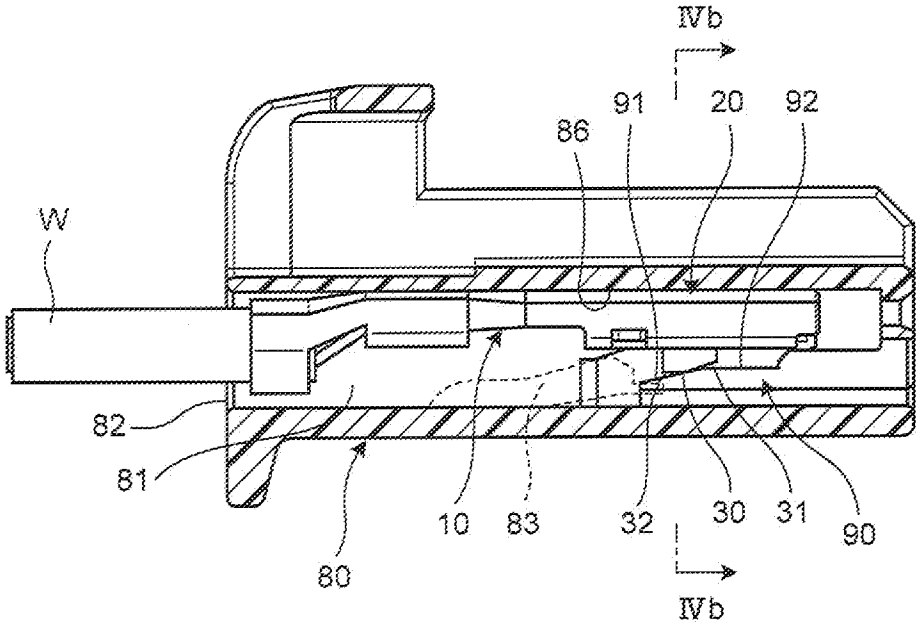
Figure 5B:
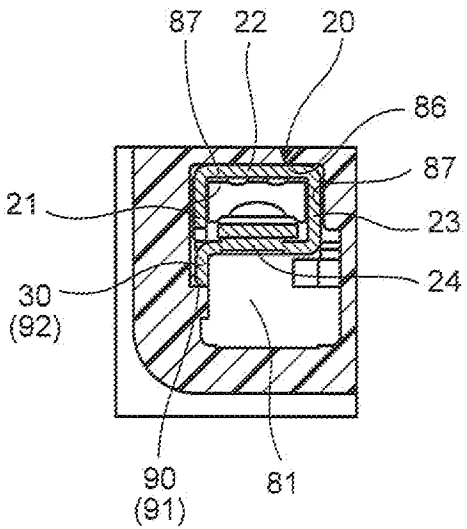
FIGS. 5A and 5B are cross-sectional views illustrating that the female terminal is inserted to a final insertion position in the cavity of the connector housing until reaching.
Figure 5A:
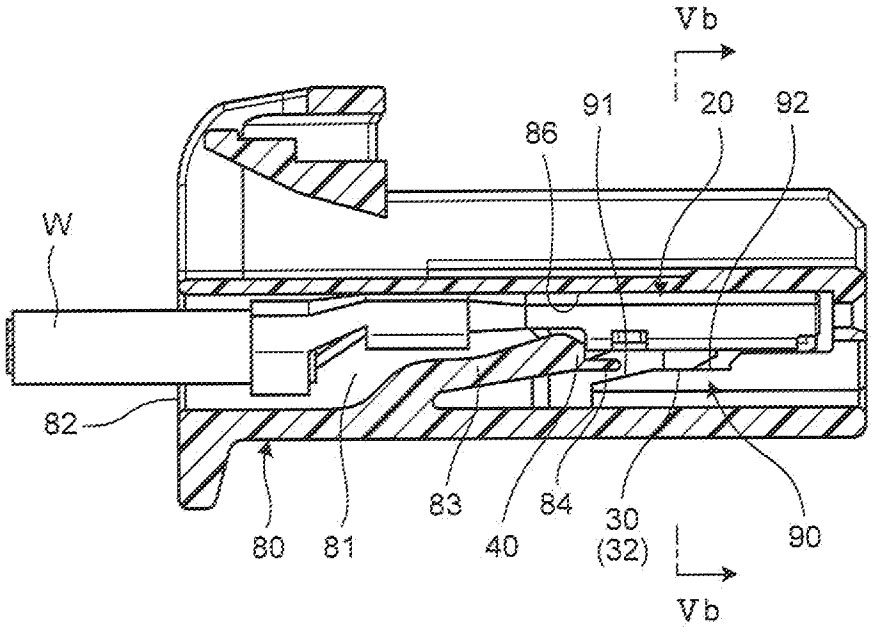
Figure 6:
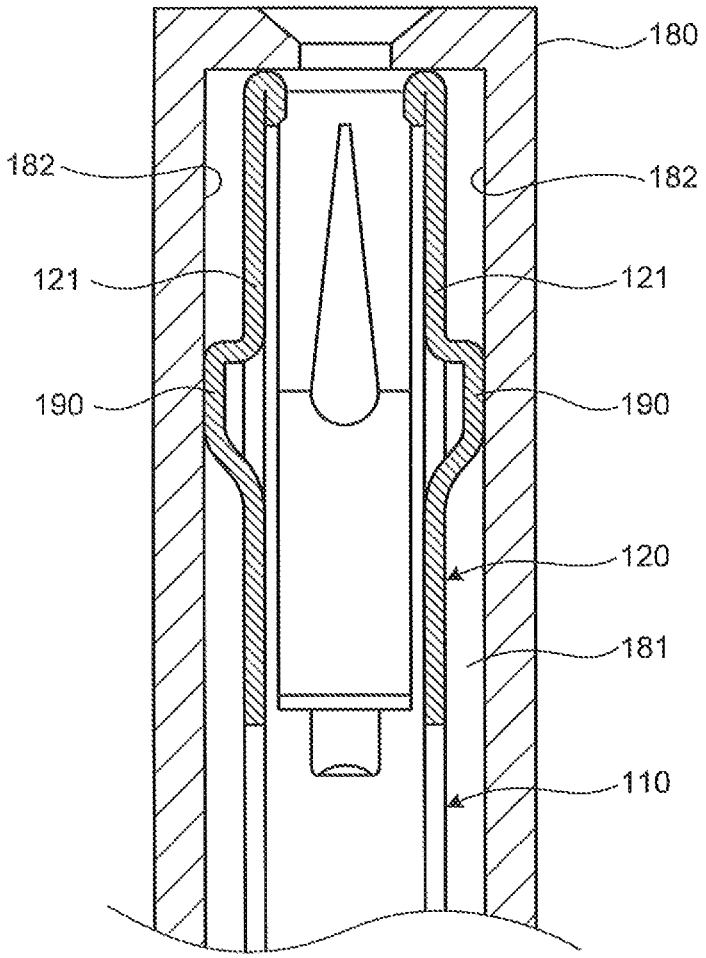
FIG. 6 is an essential part cross-sectional view of a conventional connector.

FIG. 3A and FIG. 3B are illustrative drawings illustrating that the female terminal is inserted halfway into the cavity of the connector housing, FIG. 4A and FIG. 4B are illustrative drawings illustrating that the female terminal is inserted further, and FIG. 5A and FIG. 5B are illustrative drawings illustrating that the female terminal is inserted to the final insertion position.

A thing to note about the connector is that the female terminal 10 is turned upside down, in which the upper face plate 24 is turned downward and the lower face plate 22 is turned upward, and then inserted in the cavity 81 of the connector housing 80. Therefore, the lower face plate 22 of the box part 20 in the female terminal 10 faces the ceiling wall 86 of the cavity 81, the both side plates 21 and 23 face the both side walls 87 of the cavity 81, and the upper face plate 24 faces the bottom wall 85 of the cavity 81 on which the lance 83 is mounted.

As illustrated in FIG. 3A and FIG. 3B, when the box part 20 faces toward the front direction and then the female terminal 10 is inserted in the cavity 81 of the connector housing 80 from the rear direction, the box part 20 moves so as to be bending the lance 83 downward, and accordingly the inclined portion 31 of the stabilizer 30 runs on the inclined guide portion 91 of the stabilizer guide portion 90. When the female terminal 10 is inserted further, the upper face plate 24 is pressed inward (the upper sides of FIG. 3A and FIG. 3B) while gradually accumulating a spring force by the slide of the stabilizer 30 on the inclined guide portion 91 of the stabilizer guide 90.

As illustrated in FIG. 4A and FIG. 4B, when the female terminal 10 is inserted deep further, the flat portion 32 of the stabilizer 30 runs on from the inclined guide portion 91 to the holding guide portion 92 of the stabilizer guide 90. By this movement, the angle θ1 of the bending portion in which the upper face plate 24 is bent to the second side face plate 23 changes to θ1' closed to a right angle. Simultaneously, because the stabilizer 30 tends to turn outward by contacting the side wall 87 of the cavity 81, the angle θ2 of the bending portion in which the stabilizer 30 is bent to the upper face plate 24 changes to θ2' closed to a right angle.

At this time, a spring force F1 accumulated by the bend of the upper face plate 24 acts downward to the stabilizer guide 90 via the stabilizer 30, and its reaction force presses the lower face plate 22 of the box part 20 against the ceiling wall 86 of the cavity 81. The up-and-down rattling of the female terminal 10 is thereby prevented.

While a slight gap is provided between the side face plates (the first side face plate 21 and the second side face plate 23) of the box part 20 and the side wall 87 of the cavity 81 to facilitate insertion of the female terminal 10, the stabilizer 30 exerts a pressing force on the side wall 87 of the cavity 81 because the stabilizer 30 is prevented from bending outward together with the bend of the upper face plate 24 by the side wall 87 of the cavity 81. Accordingly, the rattling of the right and left directions of the female terminal 10 is prevented by the pressing force.

When the female terminal 10 is inserted to the final insertion position, as illustrated in FIG. 5A and FIG. 5B, the female terminal 10 is fixed so as not to come off backward by locking the locking portion 84 of the lance 83 on the lance locking portion 40 in the rear side of the box part 20 while the lance 83 returns to its original position after the box part 20 passes. At this time, when the flat portion 32 of the stabilizer 30 fully gets on the holding guide portion 92 of the stabilizer guide 90, the upper face plate 24 in a bending state is stably hold on the regular position where the rectangular cylindrical shape of the box part 20 is formed. The insertion of the female terminal 10 is finished and the connector is completed in this manner.

As explained above, with the connector of this embodiment, because the upper face plate 24 formed as the spring plate can be pressed back to the regular position with accumulating the spring force while the female terminal 10 is being inserted in the cavity 81 by using the stabilizer 30 protruded outward on the box part 20 of the female terminal 10, the rattling of the female terminal 10 housed in the cavity 81 of the connector housing 80 can be prevented by the box part 20 of the female terminal 10 that exerts the pressing force on the inside wall of the cavity 81 by using the spring force. As a result, contact reliability between the female terminal 10 and a counterpart male terminal can be improved in this manner.

In particular, because the connector includes: the inclined guide portion 91 that presses back the upper face plate 24 formed as the spring plate to the regular position; and the holding guide portion 92 that holds the upper face plate 24 pressed back to the regular position at the same position, the spring force of the upper face plate 24 formed as the spring plate can be used by the slide of the stabilizer 30 inside the cavity 81 to prevent the rattling in stable conditions.

When bending the first side face plate 21 through the upper face plate 24 in order, the upper face plate 24 is not bent to the end (to the position where the upper face plate contacts or comes most close to the first side face plate 21), but is held at the bending angle θ1 halfway (held at an angle larger than a right angle). The connector thereby makes the upper face plate 24 service as a cantilevered spring plate having a fulcrum on the third bending line 27 that is the boundary between the second side face plate 23 and the upper face plate 24. Thus, using the spring property of the upper face plate 24 can prevent the rattling of the female terminal 10 inside the cavity 81 of the connector housing 80 while adopting such simple configuration.

The connector including the inclined portion 31 on the front end corner of the stabilizer 30 allows the stabilizer 30 to smoothly move during getting on the inclined guide portion 91 of the stabilizer guide 90 in the side of the connector housing 80. The connector including also the flat portion 32 on the rear side of the inclined portion 31 allows the stabilizer 30 to be held in stable conditions when the flat portion 32 finally gets on the holding guide portion 92 of the stabilizer guide 90.

In the connector, the spring force of the stabilizer 30 can also contribute to the rattling prevention of the female terminal 10, because the stabilizer 30 that lies in the same plane as the first side face plate 21 turns outward and pressingly contacts the side wall 87 with which the first side face plate 21 of the cavity 81 comes in contact when the upper face plate 24 formed as the spring plate is pressed back to the regular position while the female terminal 10 is being inserted in the cavity 81.

The present invention is not limited to the above-described embodiment, and modifications, improvements or the like may be made at any time. Also quality of materials, shape, dimensions, number, installation places, or the like of each component in the above-described embodiment are not specifically limited as long as an object of the present invention may be achieved.

In the above-described embodiment, it is explained about the configuration in which the connector includes the female terminal 10, the tab of the counterpart male terminal is inserted in the box part 20 of the female terminal 10, and the box part 20 of the female terminal 10 holds the tab of the counterpart male terminal. The configuration is not limited to the above description. In a connector including a box part having a rectangular cylindrical shape formed by four face plates and a male terminal with a tab, the configuration of the present invention may apply to the box part of the male terminal.

The present invention can prevent the rattling of the terminal after the terminal is inserted in the cavity of the connector housing while suppressing enlargement of the outside dimensions of the terminal.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electrical connector comprising:

a terminal configured to include a box part having a rectangular cylindrical shape formed by four face plates, and an electric wire connecting part in a rear direction of the box part; and a connector housing provided with a cavity accommodating the terminal and configured to lock the terminal with a lance provided in the cavity at the time the terminal is inserted in the cavity from a rear direction of the housing, wherein one face plate of the four face plates constituting the box part of the terminal is formed as a spring plate that is flared outward in a free state before the terminal is inserted in the cavity to be held in a regular position at which the rectangular cylindrical shape is formed, by deflecting inward and displacing the one face plate by being pressed inward from the outside while accumulating a spring force when the terminal inserts into the cavity, a free end of the one face plate formed as the spring plate includes a stabilizer having a protrusion shape that is protruded outward from the one face plate, and the cavity of the connector housing includes an inclined guide portion and a holding guide portion, the inclined guide portion gradually pressing back the one face plate formed as the spring plate to the regular position by sliding contact with the stabilizer while the terminal is being inserted in the cavity from the rear direction, the holding guide portion holding, at the regular position, the one face plate pressed back to the regular position when the terminal is inserted to the final insertion position.

2. The connector according to claim 1, wherein the box part has the rectangular cylindrical shape formed by the four face plates including a first side face plate, a lower face plate, a second side face plate, and an upper face plate, the first side face plate through the upper face plate are formed by bending a single metal plate inward on a first bending line as a boundary between the first side face plate and the lower face plate, a second bending line as a boundary between the lower face plate and the second side face plate, and a third bending line as a boundary between the second side face plate and the upper face plate, a bending angle of the upper face plate with respect to the second side face plate is larger than a right angle so that the upper face plate is flared outward as a cantilevered-shape spring plate having a fulcrum on the third bending line, and the stabilizer having a protrusion shape protruding outward is formed by folding on a side edge in the free end side away from the third bending line on the upper face plate.

3. The connector according to claim 2, wherein a chamfered inclined portion is formed on a corner of a front end of the stabilizer in the terminal insertion direction to the cavity, and a flat portion is formed on a rear side of the inclined portion, the flat portion extending from an apex of the inclined portion in parallel to the terminal insertion direction.

4. The connector according to claim 3, wherein the stabilizer is arranged to be in the same plane as the first side face plate in a free state before the terminal is inserted in the cavity, by setting a bending angle of the stabilizer with respect to the upper face plate flared outward at an angle larger than a right angle, and the inclined guide portion and the holding guide portion are provided on an inside wall with which the first side face plate of the cavity comes in contact.

* * * * *